US006960037B2

(12) United States Patent
Kojima et al.

(10) Patent No.: US 6,960,037 B2
(45) Date of Patent: Nov. 1, 2005

(54) PRINTER AND FEEDING CONTROL METHOD

(75) Inventors: Toshiya Kojima, Kanagawa (JP); Katsumi Enomoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 93 days.

(21) Appl. No.: 10/665,478

(22) Filed: Sep. 22, 2003

(65) Prior Publication Data

US 2004/0057770 A1 Mar. 25, 2004

(30) Foreign Application Priority Data

Sep. 20, 2002 (JP) ..... 2002-274361

(51) Int. Cl.[7] ..... B41J 11/42

(52) U.S. Cl. ..... 400/582; 400/583; 400/611; 347/9

(58) Field of Search ..... 400/582, 583, 400/611, 283, 284; 347/9–15, 40–43

(56) References Cited

U.S. PATENT DOCUMENTS 5,847,721 A * 12/1998 Ogata et al. ..... 347/9
5,988,790 A 11/1999 Koike et al.
6,116,795 A * 9/2000 Ogasawara ..... 400/582
6,328,400 B1 12/2001 Yonekubo et al.
6,371,609 B1 * 4/2002 Oikawa ..... 347/96

FOREIGN PATENT DOCUMENTS

JP 60-107975 A 6/1985
JP 07-052465 A 2/1995

* cited by examiner

*Primary Examiner*—Minh Chau
(74) *Attorney, Agent, or Firm*—Sughrue Mion, PLLC

(57) ABSTRACT

An ink jet head is fed in a main-scan direction to record one line on a recording paper. Thereafter, the recording paper is fed in a sub-scan direction for one line. A corrected feeding amount A is calculated by adding a correction value C1 to a basic feeding amount B. The correction value C1 is determined by a formula, $C1=2\cdot D\cdot(R-\frac{1}{2})$, wherein p represents an interval between dots recorded on recording paper in the sub-scan direction, and k represents a range of unevenness in the feeding amount caused by structural factors of sub-scan feeding means. For example, $D=(p-k)/2$. R is a random number in a range between 0 and 1. Gradation unevenness and/or black and white streaks caused by periodical feeding unevenness become inconspicuous since the correction value C1 is changed on a random basis.

14 Claims, 8 Drawing Sheets

PRINTER AND FEEDING CONTROL METHOD

BACKGROUND OF THE INVENTION

1. Field of the Invention

The present invention relates to a printer and a feeding control method.

2. Background Arts

As apparatuses for recording images on recording paper, there are ink-jet printer, thermal printer, and so forth. Each printer has a recording head with an array of plural recording elements, and records images by driving the recording head while feeding recording paper in a feeding direction.

When there is unevenness in feeding amount of recording paper (feeding unevenness), black and white streaks are likely to appear in recorded images. U.S. Pat. No. 5,988,790 discloses a recording method which carries out interlace recording by using the recording head with an array of N recording elements. The printer prevents streaks caused by feeding unevenness by alternately using first recording element and number N recording element for recording the same line. U.S. Pat. No. 6,328,400 discloses a recording method which feeds recording paper by a constant amount which is different from an interval between dot forming elements (such as recording nozzles) in the feeding direction (sub-scan direction). U.S. Pat. No. 6,328,400 discloses an art which makes streaks caused by feeding unevenness inconspicuous by setting an interval between dots smaller than the interval between dot forming elements.

However, gradation unevenness may appear periodically even if images are recorded by above recording methods. The periodical gradation unevenness is caused by unevenness in gear cutting in speed reduction mechanism which transfers the rotation of the feeding motor to the feeding roller. The black and white streaks may also periodically appear in recording paper by splicing the dots or by making the dots apart due to the feeding unevenness. It is difficult to quantitatively examine the amount of feeding unevenness caused by each factor, since the above factors affect the feeding unevenness in combination.

Japanese Patent Laid-Open Publication No. 7-52645 discloses a method for recording images, in which the recording paper feeding amount is changed by multiplying the pitch of recording elements by a random integer. Thereby, widths of recorded lines, which are recorded by the recording head, vary on a random basis. As a result, the streaks, which appear in the splice portion, become inconspicuous by changing the periodicity of streaks on a random basis. However, the black and white streaks, which appear in the splice portion of recording area due to periodical unevenness in the feeding amount, cannot be prevented effectively by applying the above feeding method, since the feeding amount is determined by the integral multiple of the pitch of the recording elements.

SUMMARY OF THE INVENTION

In view of the foregoing problem, an object of the present invention is to provide a printer and a feeding control method for preventing periodical occurrence of black and white streaks, which is caused by unevenness in feeding amount of a recording material.

To achieve the above object, a correction value is determined on a random basis within a predetermined range for relatively feeding a recording head and the recording material with a corrected feeding amount, which is obtained by adding the correction value to a predetermined basic value. It is preferable to carry out relative feeding for m times with the corrected feeding amount in every n times of relative feeding ($n \geqq m$). It is also possible to determine a random natural number R1 to carry out one relative feeding with the corrected feeding amount in every R1 times of relative feeding.

In a preferable embodiment, the relative feeding is carried out by relatively feeding the recording material in the first direction each time. In that case, the correction value C1 is determined to satisfy one of the following formulae.

$$|C1|<(p-k)/2$$

$$|C1|<k$$

$$|C1|<15\ \mu m$$

wherein, p represents an interval between recording dots on the recording material in the first direction, k is a range of unevenness caused by structural factors of the feeding mechanism.

It is preferable to store the correction value in a memory in each relative feeding, and to determine the corrected feeding amount by reading the correction value from the memory for recording next image. Thereby, it becomes possible to reduce time for calculating the correction value.

According to the present invention, periodical occurrence of gradation unevenness and the black and white streaks can be prevented by determining the corrected feeding amount of the recording material and the recording head on a random basis.

BRIEF DESCRIPTION OF THE DRAWINGS

The above objects and advantages of the present invention will become apparent from the following detailed descriptions of the preferred embodiments when read in association with the accompanying drawings, which are given by way of illustration only and thus do not limit the present invention. In the drawings, the same reference numerals designate like or corresponding parts throughout the several views, and wherein.

DETAILED DESCRIPTION OF THE EMBODIMENTS

Figure 1:
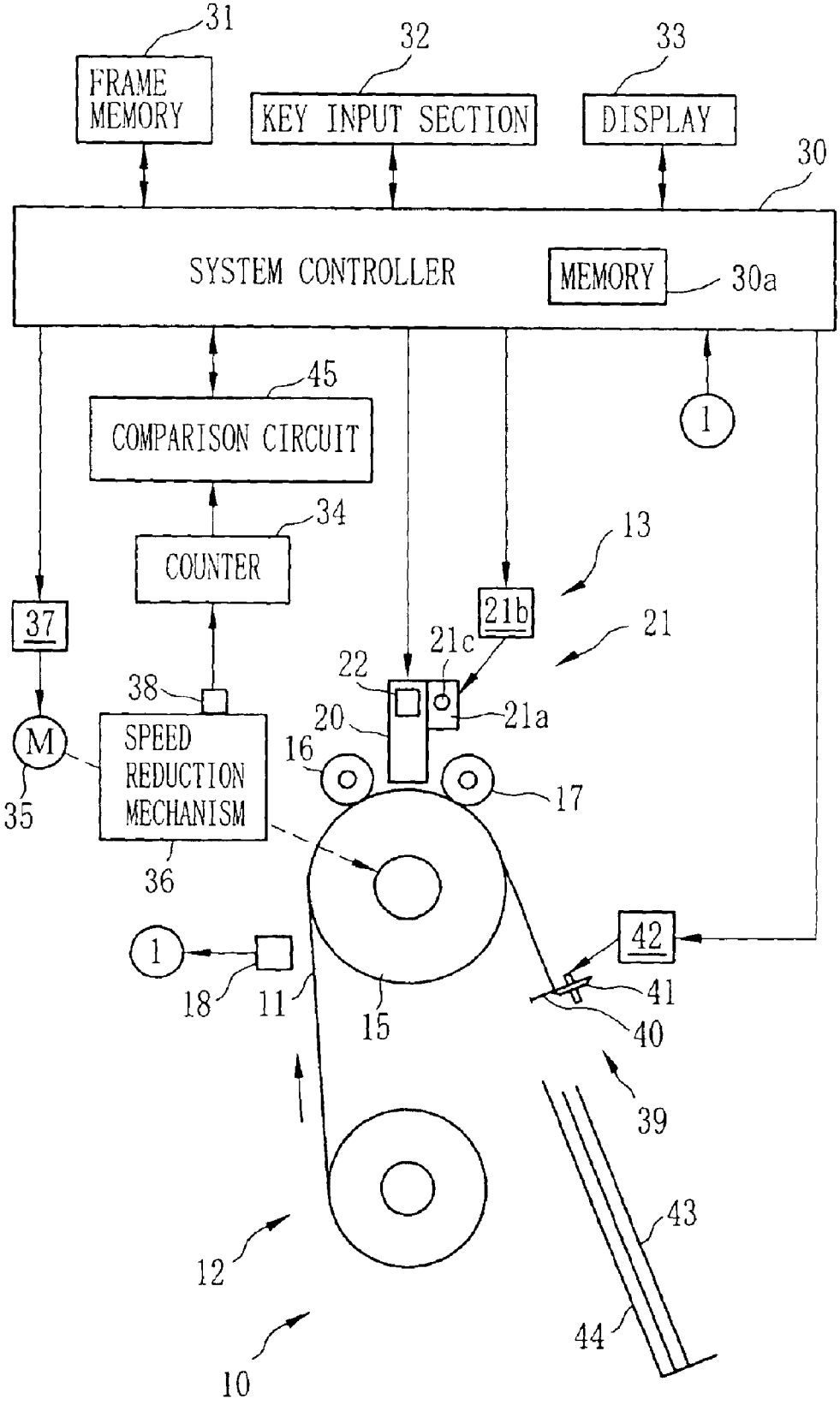
FIG. 1 is a schematic view illustrating an ink jet printer according to an embodiment of the present invention.

Referring to FIG. 1, in an ink jet printer 10, long recording paper 11 used as a recording material is loaded in a paper feed section 12 in a roll form. Recording paper 11 is drawn from the paper feed section 12 and is fed to a recording section 13.

A platen roller 15, press rollers 16 and 17, an end-detection sensor 18, an ink jet head 20, and a carriage 21 are provided in the recording section 13.

Figure 2:
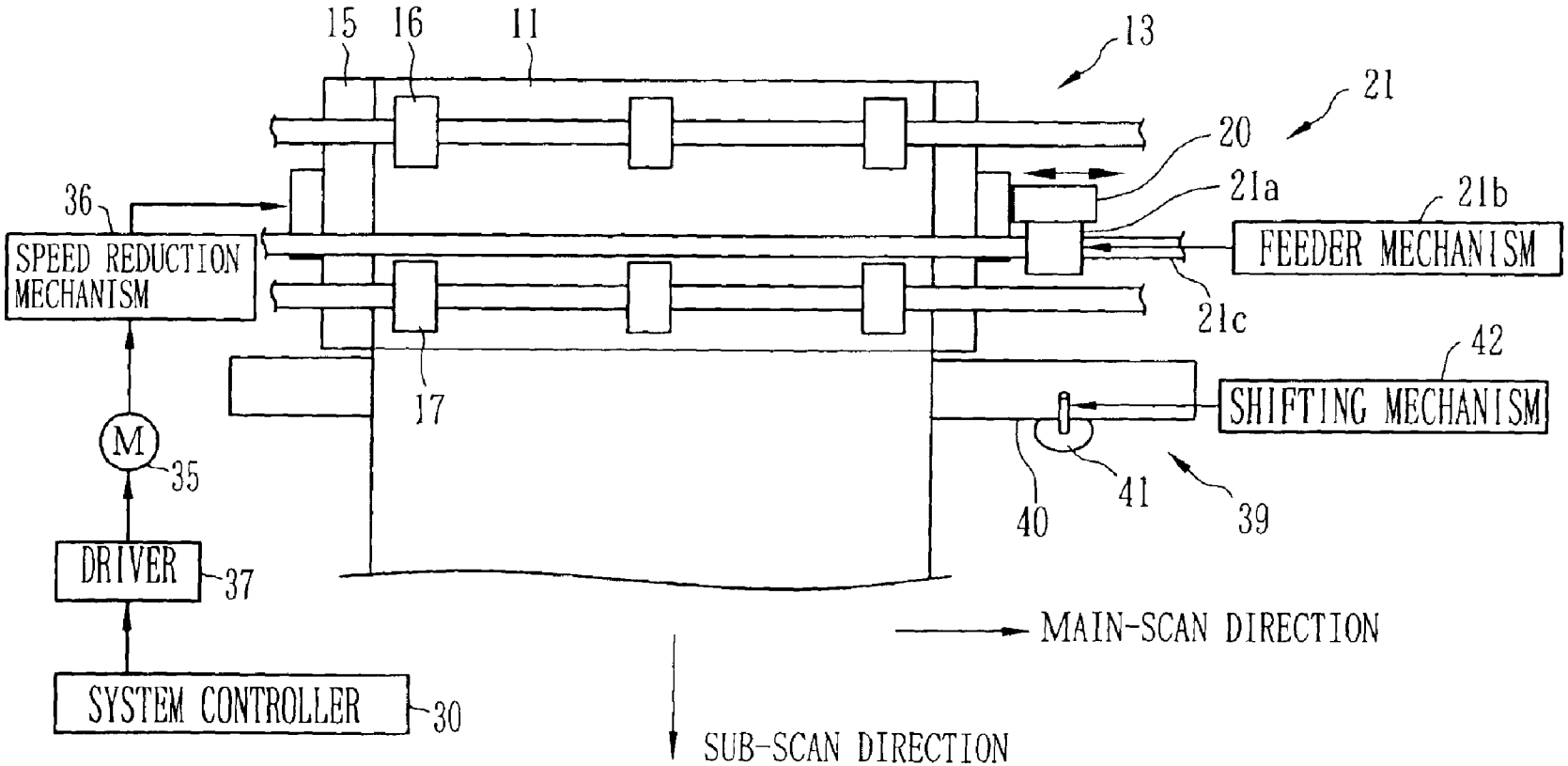
FIG. 2 is a plan view illustrating a recording section.

Referring to FIG. 2, the ink jet head 20 is shifted in the width direction (a main scan direction) of the recording paper 11 by the carriage 21 to record the image by one line in the main scan direction. The carriage 21 has a carriage body 21*a*, which retains the ink jet head 20, a feeder mechanism 21*b*, and a guide shaft 21*c*. The feeder mechanism 21*b* comprises an endless belt that is looped over a pulley, and a carriage motor to rotates the endless belt.

In the ink jet head 20, nozzles 62 (See FIG. 8) as recording elements are arranged in line in the sub-scan direction with respect to each color, yellow (Y), magenta (M), cyan (C), and black (K). It is well-known that piezoelectric element is disposed in ink flow path close to each nozzle 62 in the ink jet head 20. The ink is ejected and supplied by driving the piezoelectric-elements. Instead of employing the piezoelectric elements, it is possible to use well-known devices, such as a heater for ejecting the ink. Although the above four colors are used in this embodiment, other colors such as light magenta, light cyan, dark yellow, and so forth can be also used.

As illustrated in FIG. 1, each piezoelectric element is controlled by a head drive circuit 22 in the ink jet head 20. The head drive circuit 22 is connected to a system controller 30, and provides drive signals to each piezoelectric element according to image data. A frame memory 31, a key input section 32 and a display 33 are connected to the system controller 30. Image data obtained from an image scanning device or an image output device is written in the frame memory 31.

The system controller 30 calculates drive data of piezoelectric element in the nozzle of each color according to image data of each color, and sends drive data to the head drive circuit 22. The head drive circuit 22 drives each piezoelectric element in synchronism with the feeding of the carriage 21. Thereby, ink droplets with the size according to pixel density (gradation value) are ejected to adhere to recording paper 11. Accordingly, a full-color image is recorded on recording paper 11 by adhering ink of Y, M, C, and K. Gradation can be controlled by methods to control the dot diameter, the dot density, and so forth. High quality image of the print can be achieved by applying one of the above methods or combining above methods.

The platen roller 15 is rotated by a feeding motor 35 and a speed reduction mechanism 36 which has plural gears. The platen roller 15 feeds recording paper 11 in the sub-scan direction after recording one line image by shifting the ink jet head 20. The system controller 30 controls the feeding motor 35 through a driver 37.

As shown in FIG. 1, the end-detection sensor 18 to detect passing of the front end of recording paper 11 is disposed in upstream side with respect to the platen roller 15. The detection signal is sent to the system controller 30. An encoder 38 is provided in a gear shaft (not shown) in the speed reduction mechanism 36 in the proximity of a platen roller shaft. The encoder 38 is constituted of, for example, a disc and a photo interruptor. In the disc, plural slits of the same pitch are formed radially. The photo interruptor generates the number of pulses according to the rotation speed by detecting passing of the slits.

A counter 34 counts the number of the pulses from the encoder 38, and sends pulse number data to a comparison circuit 45. The system controller 30 has a memory 30 that stores set feeding amount value data corresponding to set feeding amount, which is input in the comparison circuit 45. The comparison circuit 45 compares the set feeding amount value data with pulse number data in the counter 34 and sends a count-up signal to the system controller 30 when pulse number coincides with the set feeding amount value. The system controller 30 stops the rotation of the motor 35 in response to the count-up signal to set recording paper 11 in the predetermined position. The feeding mechanism of the recording paper 11 is not limited to the above formation. It is possible to use other mechanisms for feeding the recording paper 11.

Examples of the set feeding amount are as follows: a feeding amount to start recording, an intermittent feeding amount of one line in the sub-scan direction (one-line feeding amount), and a feeding amount to complete recording. The feeding amount to start recording is an amount to feed the front end of recording paper 11 from the end-detection sensor 18 to a recording start position. The feeding amount to complete recording is an amount to feed recording paper 11 until the image boundary reaches a cut position. The intermittent feeding amount in sub-scan direction is the sum of the basic feeding amount and the correction value which varies on a random basis.

A cutter device 39 has a stationary cutter bar 40, a rotary cutter 41, and a shifting mechanism 42. The stationary cutter bar 40 is set in the width direction of recording paper 11. The shifting mechanism 42 shifts the rotary cutter 41 along the stationary cutter bar 40. The recording paper 11 is cut off in the width direction by shifting the rotary cutter 41. The recording paper 11 is cut off at a boundary of each image as a print 43 as shown in FIG. 1. The print 43, which has been cut off, is ejected in a tray 44.

While being fed in the sub-scan direction, the feeding amount of the recording paper may vary periodically because of unevenness in gear cutting in the speed reduction mechanism 36 or off-center of the platen roller 15. It is difficult to quantitatively examine the amount of feeding unevenness caused by each factor, since the above factors affect the feeding in combination.

For that reason, a corrected one-line feeding amount A in the sub-scan direction after recording each line is determined by adding a correction value C1, which varies on a random basis, to a basic feeding amount B, in order to prevent the black and white streaks and gradation unevenness and to make them inconspicuous. However, the streaks cannot be prevented effectively only by changing the correction value C1. Therefore, the correction value C1 is changed within the following range.

Figure 3:
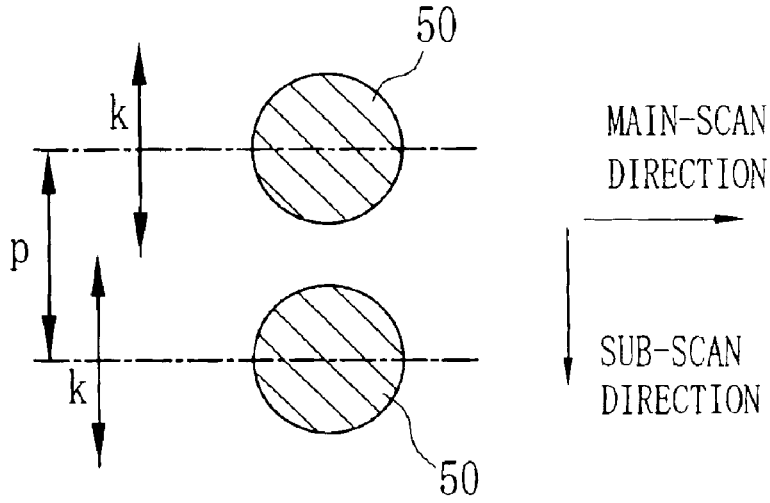
FIGS. 3, 4A, 4B and 4C are explanatory views illustrating the relationship between an interval between dots on recording paper and a range of unevenness in feeding amount, which is caused by structural factors of speed reduction mechanism.

Referring to FIG. 3, an absolute value |C1| is set to satisfy the following formula (1), when p represents an interval between dots 50 recorded on recording paper 11 by recording element (nozzle 62) in the sub-scan direction (namely, design feeding amount), and k represents a range of feeding unevenness caused by structural factors of sub-scan feeding means, such as the motor 35, the speed reduction mechanism 36, and the platen roller 15.

$$|C1|<(p-k)/2 \quad (1)$$

The range of feeding unevenness k is obtained previously by experiment, for example. The range of feeding unevenness k can also be obtained from samples in test print prior to shipment of the printer from the factory. As for the range of feeding unevenness k, any of the following ranges can be employed: a range between a maximum value and a minimum value, a range of standard deviation value σ in normal distribution of feeding unevenness or an integral multiple of σ (for example, 3σ), a range of average feeding unevenness, or a range of maximum feeding unevenness. When the correction value C1 is determined within the above range, the black and white streaks having a width of equal to or more than 1 dot and gradation unevenness can be prevented even if there is unevenness in actual feeding amount. Particularly, periodical occurrences of streaks and gradation unevenness are reduced and become inconspicuous by changing the correction value C1 on a random basis.

Figures 4A, 4B, 4C:
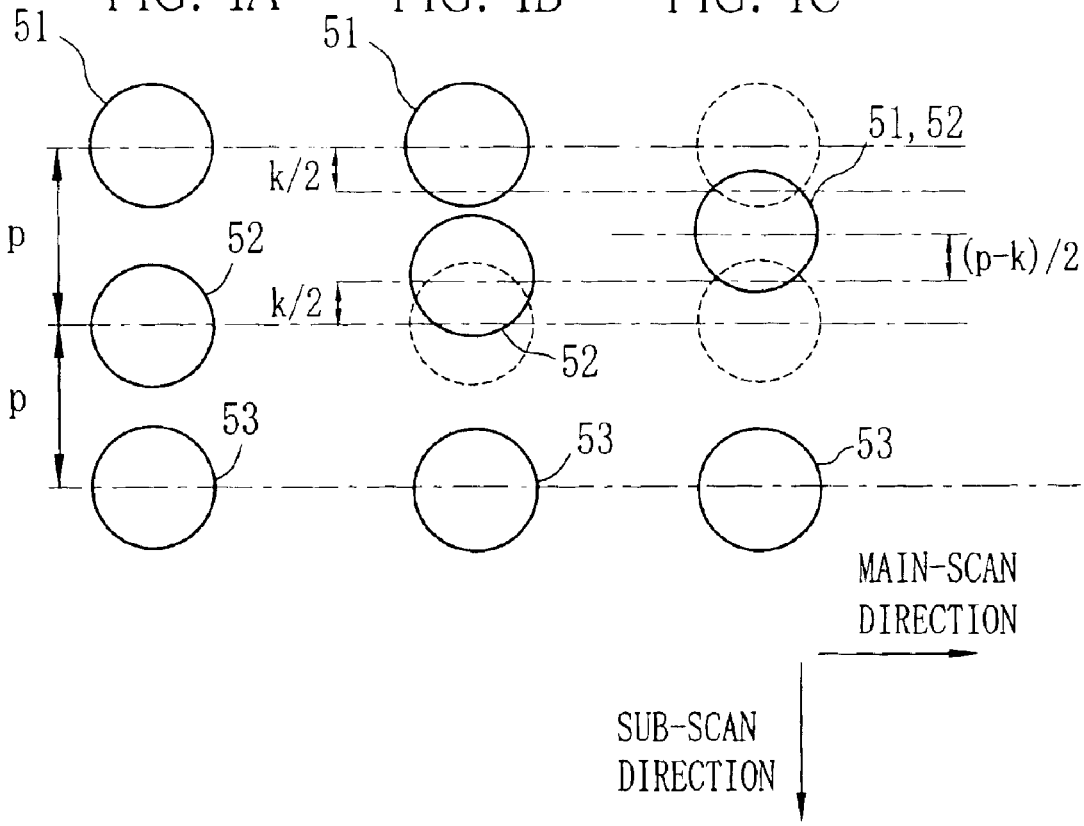

The formula (1) is determined in view of preventing granularity degradation or collapse of image structure. That is, the formula (1) is the condition in which neighboring dots do not transpose their positions in the first direction even if the correction value |C1| has been added. FIG. 4A shows the situation in which first, second and third dots 51, 52 and 53 are on the recording paper 11 at the same pitch p. In FIG. 4B, the second dot 52 is shifted by k toward the first dot 51. In that case, if the position of the second dot 52 is corrected by (p−k)/2 toward the first dot 51, and if the position of the first dot 51 is corrected by (p−k)/2 toward the second dot 52, the first and second dots 51, 52 are completely overlapped, as shown in FIG. 4C. Thus, the maximum of the correction value C1 is determined within the range of (p−k)/2.

Instead of using above formula (1), |C1| can also be determined within the following range. It is also possible to prevent the periodical streaks and gradation unevenness effectively.

$$|C1|<k \tag{2}$$

In the multi-path recording method, unevenness in the feeding amount results in unevenness in nozzle interval periodicity. Usually, the periodicity of nozzle interval unevenness is so low that the unevenness is likely to be visible, since nozzle intervals are 4–8 times longer than dot intervals. Therefore, nozzle interval unevenness decreases by providing dot position fluctuation within a range of unevenness k. The nozzle interval unevenness is thereby buried in dot interval fluctuation. In that case, granularity at a frequency equivalent to dot interval is degraded. However, the granularity frequency becomes comparatively high, since the dot interval has shorter periodicity than the nozzle interval. Accordingly, the visibility of unevenness decreases.

The unevenness becomes an important problem when high image quality is required (printing photographs, for instance). The high image quality printers frequently use the dot, whose diameter is smaller than 30 μm, in order to decrease graininess. Therefore, when the dots are printed on the whole page, it is necessary to make the diameter of print dropouts not to exceed 30 μm. The unevenness is most apparent when the dots are printed so closely that the adjacent dots almost contact each other. In that case, the print dropout with the diameter of 30 μm appears if neighboring two dots in the sub-scan direction are shifted for 15 μm respectively in the opposite direction. For that reason, in order to make the print dropout diameter smaller than 30 μm, the condition |C1|<15 μm is preferable.

In the above formula (2), deviation from design feeding amount changes within the range of k on a random basis. It becomes difficult to visually identify the periodical unevenness in gradation or streaks by making the periodicity of the feeding unevenness higher.

Figure 5:
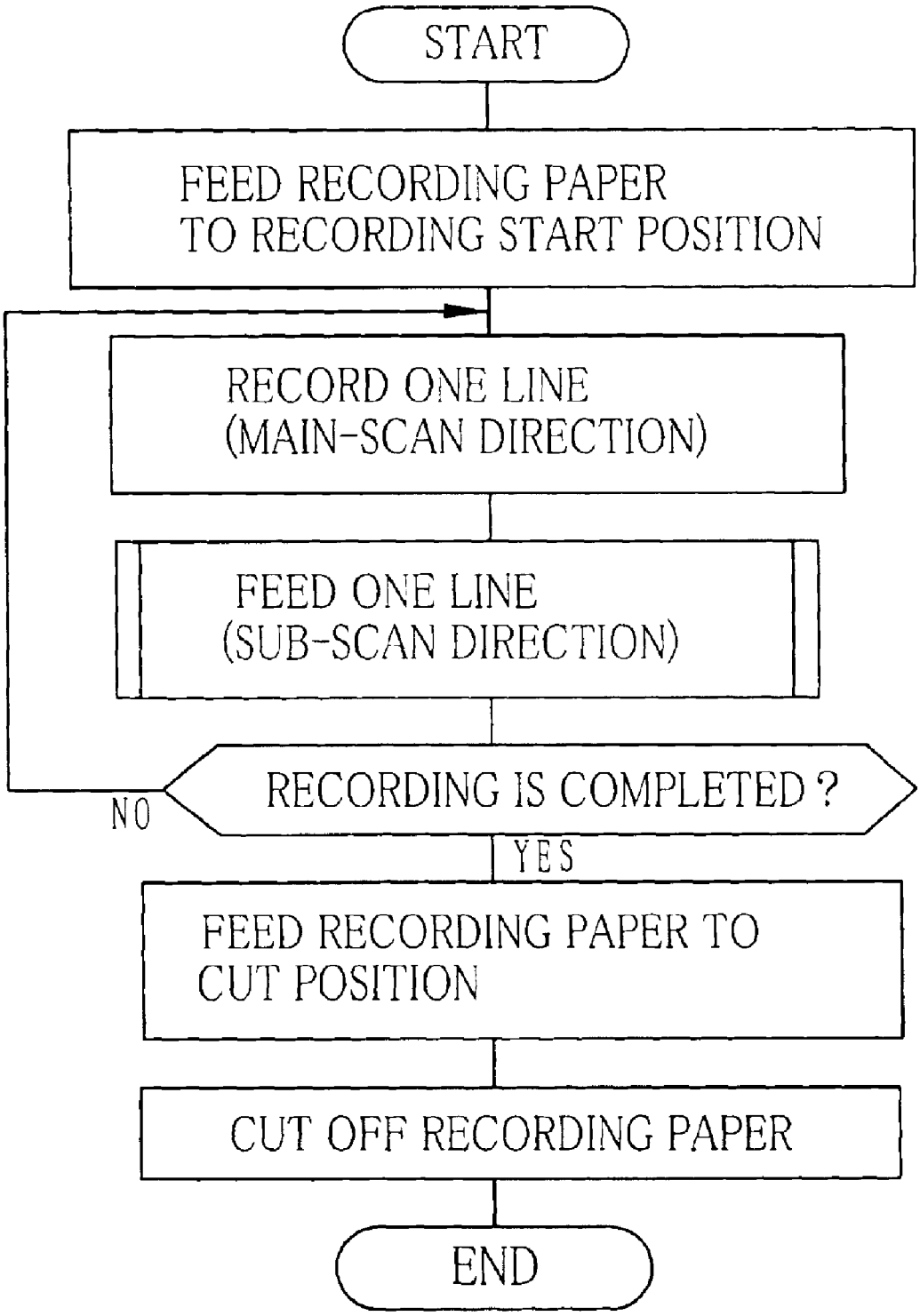
FIG. 5 is a flow chart of the printing process.
Figure 6:
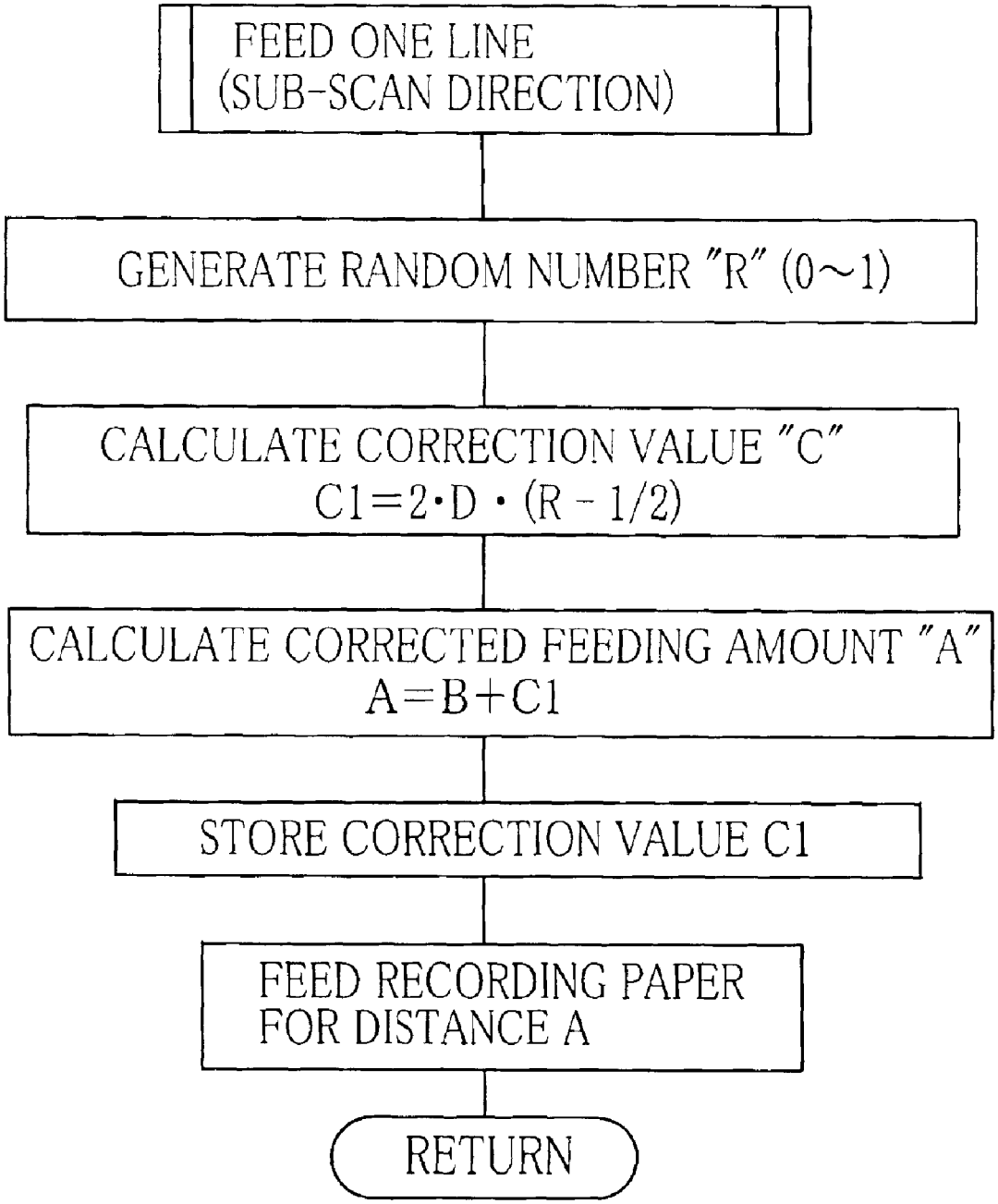
FIG. 6 is a flow chart of an example of feeding process in a sub-scan direction.

FIG. 5 and FIG. 6 illustrate an example to record an image in the recording paper 11. Referring to FIG. 4, when a print start key in the key input section 32 is operated, the recording paper 11 is fed to the recording start position, in which the front end of the recording area is underneath the ink jet head 20. Then, the piezoelectric element in each nozzle in the ink jet head 20 is driven in synchronism with the movement of the carriage 21 in the main-scan direction according to one line of image data. The ink droplets are ejected to the recording paper 11 according to image data to record one line in the main-scan direction. After recording one line in the main-scan direction, the recording paper 11 is fed by one line in the sub-scan direction.

In the above process, conventional printers feed recording paper by the basic feeding amount B. However, according to the present embodiment, corrected feeding amount A in the sub-scan direction is determined by adding the correction value C1 to the basic feeding amount B as shown in FIG. 6. In this embodiment, the correction value C1 is calculated by the following formula (3).

$$C1=2\cdot D\cdot(R-½) \tag{3}$$

D takes the value of (p−k)/2, k, or 15 μm. R is a random number within a range of 0 to 1. The probability of C1 taking a plus value and that of taking a minus value becomes approximately equal by subtracting ½. Accordingly, the recorded length in the sub-scan direction does not fluctuate even if the corrected feeding is repeated, since the cumulative corrected feeding amount becomes approximately equal to zero when completing the recording of one image. The method for setting C1 to have the same probabilities in taking plus value and minus value is not limited to the above formula (3). In the above embodiment, D=(p−k)/2. It is possible to apply any number.

The correction value C1 is calculated by applying the random number, for example from 0 to 1, to the above formula (3), so that the correction value C1 takes a random value, which does not exceed the value of (p−k)/2. As the correction value C1 takes a random value, periodical occurrence of the streaks can be prevented by canceling the periodicity by the correction value C1. As a result, the streaks become inconspicuous. It is also possible to prevent black and white streaks of 1 dot or more, effectively by satisfying the above formula (1) and by determining the upper limit of the correction value C1.

The value D is determined among (p−k)/2, k, or 15 μm, in consideration of required image quality. For example, when decreasing the visibility of unevenness is a matter of the highest priority, the maximum value of the above three conditions is used. When preventing granularity degradation is the matter of the highest priority, the larger value of (p−k)/2 and k is used. In that case, 15 μm is used as an upper limit.

The correction value C1 is stored in a memory 30*a* in accordance with the line number after recording each line. It is also possible to store correction value C1 in a RAM (not shown), which is connected to the system controller 30. The stored correction value C1 is applied to the next printing of the same size. When printing the same size, the print quality becomes approximately equal to the previous printing by applying the same correction value. It is also possible to record a series of correction values only when an operator visually identified that the printing has been carried out without streaks. A series of random numbers can be stored instead of recording the series of the correction values.

Referring to FIG. 5, when all the lines have been recorded, recording paper 11 is stopped after feeding the predetermined amount so as to set the boundary of the image in the cut position. Thereafter, the cut section 39 is actuated to cut off the printed portion from recording paper 11. The cut off portion is ejected to the tray 44 as the print 43.

In the above embodiment, the correction value C1 is added to the basic feeding amount. The correction value C1 is generated on a random basis every time recording paper 11 is fed. It is also possible to add the correction value C1 to the basic feeding amount once or plural times in every two lines or more. Referring to a flow chart of FIG. 7, invariables "a" and "b" are previously determined to calculate the feeding amount by adding the random correction value C1 to the basic feeding amount for "b" times in every "a" times. In the remaining (a–b) times of feeding, the recording paper 11 is fed by the basic feeding amount. "a" is a natural number equal to or more than 2, and "b" is a natural number equal to or more than 1, under the relationship of a>b.

For example, when a=3, and b=1, the recording paper 11 is fed in the sub-scan direction by the feeding amount, to which the correction value is added once in every three times of feeding. The recording paper 11 is fed in the sub-scan direction by the basic feeding amount two times in three times of feeding. Thus, the influence by the periodical unevenness is decreased to make the gradation unevenness and the black and white streaks inconspicuous by feeding the recording paper 11 by the amount, to which the correction value has been added in predetermined ratio.

Figure 7:
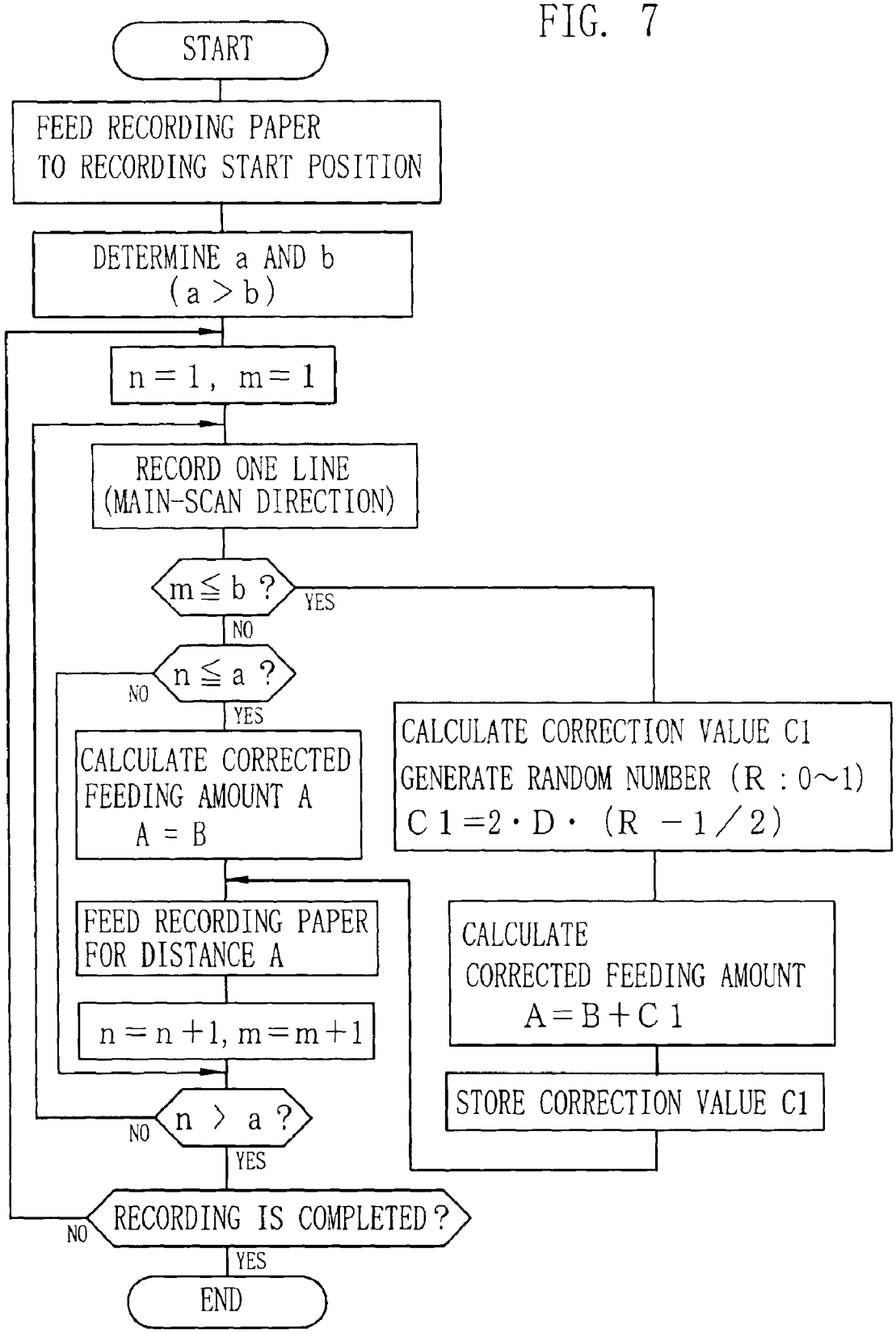
FIG. 7 is a flow chart of another example of the feeding process in the sub-scan direction.

In the example described by FIG. 7, the recording paper 11 is fed for "b" times by the amount, to which the correction value has been added, for "b" times. Thereafter, recording paper 11 is fed by the basic feeding amount for (a–b) times. It is also possible to determine whether to add the correction value on a random basis. It is possible to feed recording paper 11 by the corrected feeding amount, for "b" times while feeding recording paper 11 for "a" times. It is also possible change values of "a" and "b" as necessary to carry out the feeding in the sub-scan direction.

Figure 8:
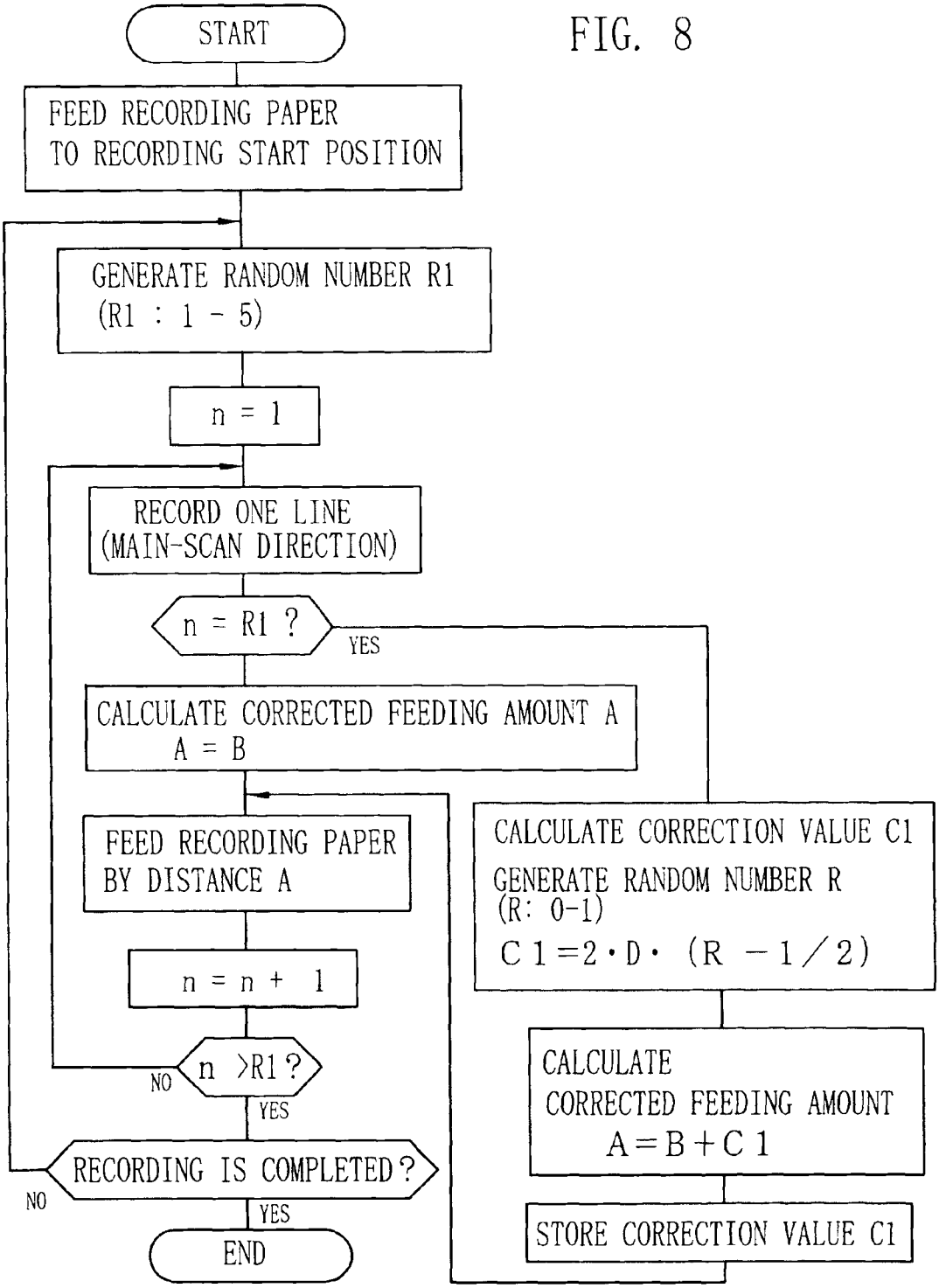
FIG. 8 is a flow chart of further example of the feeding process in the sub-scan direction.
Figure 9:
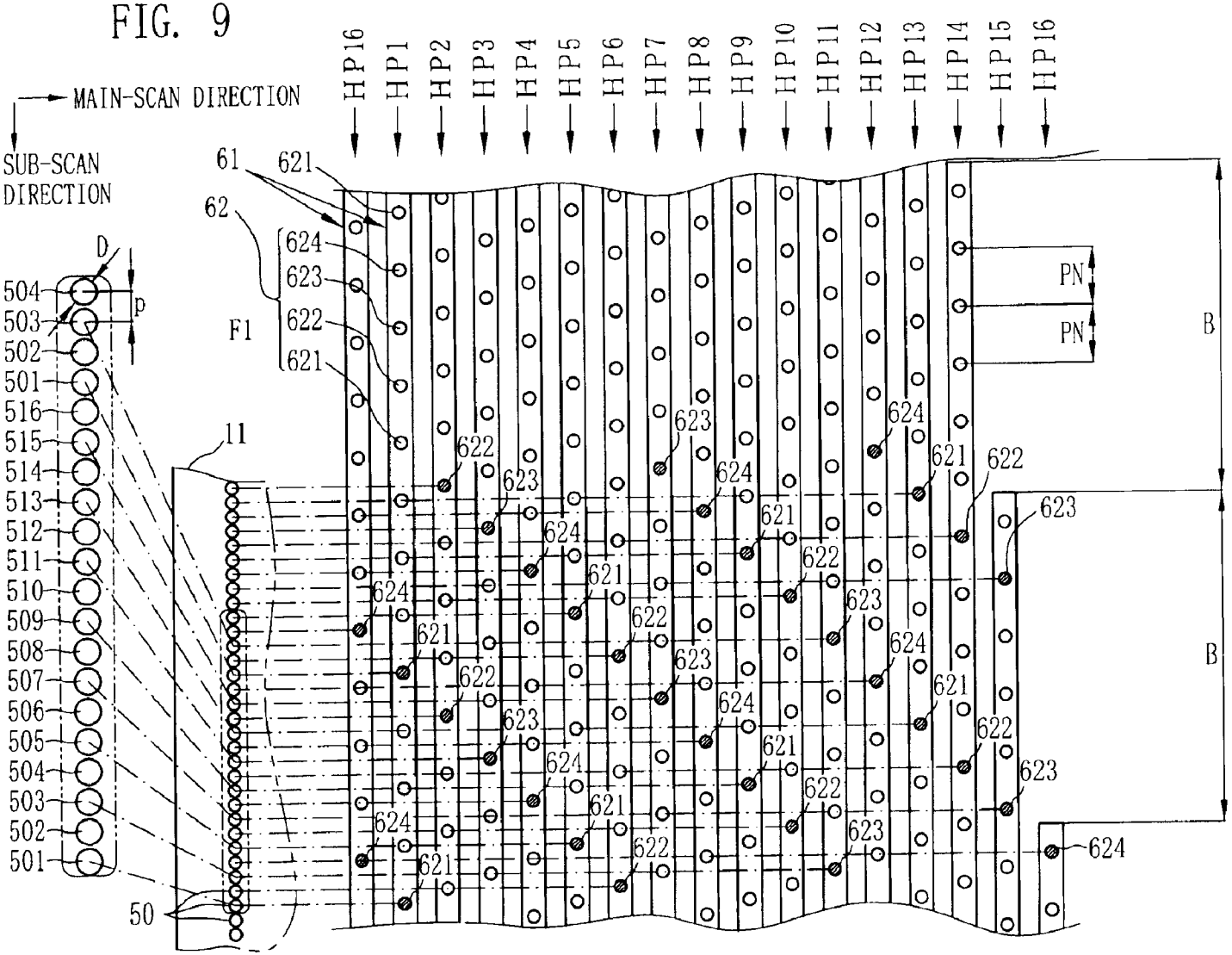
FIG. 9 is a schematic view illustrating an array of recording dots arranged in the sub-scan direction by a multi-path type ink jet head.

Referring to an example shown in FIG. 8, a random number R1 is determined within a range of 1–5. The recording paper 11 is fed by the basic feeding amount for (R1–1) times. Then, the recording paper 11 is fed by the corrected feeding amount. The above processes may be repeated. It is possible to determine the range of the random number R1 as necessary. The range between 1 and 10 is preferable. The range between 1 and 5 is more preferable. Accordingly, visibility of the periodical gradation unevenness and the black and white streaks becomes even more decreased. It is also possible to feed the recording paper 11 by the corrected feeding amount, for one time after feeding by the basic feeding amount for predetermined times on a random basis. The above processes may be repeated.

In the above embodiment, the random number R1 is generated within a range of 0–1. However, the range can be changed according to the range of the correction value C1. It is also possible to generate the random number at a frequency to which weights are assigned with normal distribution by using standard deviation σ. It is not necessary to use random numbers if the correction value C1 could be changed on a random basis. A random number table can be used instead of generating the random numbers. The same sequence of random numbers can be used when the image or the image size is the same as those in the previous printing.

A serial printer is used in the above embodiment; however, a line printer can also be used, which records an image by feeding the recording paper in the sub-scan direction according to the line head with the nozzles aligned in the main-scan direction. The present invention can also be applied to the sub-scan feeding in multi-path recording method, which is disclosed in Japanese Patent Laid Open Publications No. 60-107975 and Japanese Patent Laid Open Publications No. 7-52465.

In the above embodiment, the platen roller drive system is illustrated as an example. However, other systems can be used for feeding the recording paper to the sub-scan direction. For example, when carrier roller sets are used, the encoder is provided for controlling the rotation of the pulse motor to rotate the carrier roller, and for controlling the speed reduction mechanism in the same manner as the above embodiment.

The ink jet printer is used in the above embodiment; however, other recording methods such as a thermal printer or a printer of exposure type can also be used to the present invention. Sub-scan feeding is carried out in the above embodiment; however, the present invention can also be applied to feeding the ink jet head in the main-scan direction. Recording paper of roll type was used in the above embodiment; however, cut-sheet recording paper can also be used for the present invention.

Although the present invention has been described with respect to the preferred embodiment, the present invention is not to be limited to the above embodiment, but, on the contrary, various modifications will be possible to those skilled in the art without departing from the scope of claims appended hereto.

EXAMPLE

An experiment is carried out for verifying the effect of the above embodiment.

In FIG. 8, although ink jet head 61 has nozzles of 4 colors, Y, M, C, and K, only nozzle 62 of one color is shown (for not making the figure complicated). HP1 represents a position (a head position) of the ink jet head 61 in the sub-scan direction during the first recording (first scanning) in the main-scan direction. Each of HP2–HP16 represents the position of the ink jet head 61 in the sub-scan direction during $2^{nd}$ to $16^{th}$ scanning. Note that the head positions HP1–HP16 are shifted in the main-scan direction in the figure not to make the figure unclear by overlaying HP1–HP16 in the same position in the main-scan direction.

In the example, the ink jet head 20 has 92 nozzles 62 in the sub-scan direction with the nozzle pitch PN of 141.1 μm. The basic feeding amount B is 811.4 μm. A diameter of the dot recorded on the recording paper 11 is 30–60 μm. A pitch p between the dots is 35.3 μm. Feeding unevenness k caused by structural factors of the sub-scan feeding mechanism (see FIG. 1) is ±2 μm. The ranges of the correction value C1 are "0", "±3 μm", "±6 μm", "±10 μm", "±15 μm", "±20 μm", and "±30 μm". images are recorded by multi-path method, in which a line is recorded in 16 passes in the main-scan direction. Recording is carried out by using ¼ of all nozzles 62 in one pass in the main-scan direction. The remaining nozzles, which were not used in the previous recording, are used for next scanning.

As is enlarged in the figure, recording dots 501–516 are aligned in the sub-scan direction. The recording dot 501 is recorded by the first scanning. The recording dot 514 is recorded by the second scanning. The recording dot 511 is recorded by the third scanning. The recording dot 508 is recorded by the forth scanning. The recording dot 505 is recorded by the fifth scanning. Likewise, the recording dot 504 is recorded by the 16th scanning in the sub-scan direction. In the first scanning, nozzles 621 of first group of the neighboring four nozzles are used for recording the dot 501. In the second scanning, nozzles 622 of second group are used for recording the dot 514. In the third scanning, the nozzles 623 of third group are used for recording the dot 511. Likewise, in the forth scanning, nozzles 624 of forth group are used for recording 508. In the $5^{th}$, $9^{th}$, and $13^{th}$ scanning, the nozzles 621 of the first group are used for recording 505, 509, and 513. In the $6^{th}$, $10^{th}$, and $14^{th}$ scanning, the nozzles 622 of the second group are used for recording the dot 502, 506, and 510. In the $7^{th}$, $11^{th}$, and $15^{th}$ scanning, the nozzles 623 of the third group are used for recording the dot 515, 503, 507. In the $8^{th}$, $12^{th}$, and $16^{th}$ scanning, the nozzles 624 in the forth group are used for recording the dot 512, 516, and 504. Each line of images is recorded sequentially by repeating the above process.

When examining the print obtained in the above example, several streaks are observed when the correction value C1 is 0. Frequency and visibility of the periodical occurrence of streaks is increased when the correction value C1 exceeds ±15 μm. When the correction value C1 is determined in the range between ±3 μm and ±15 μm, periodical occurrence of streaks are not visually observed. It is verified to be effective for preventing streaks.

What is claimed is:

1. A feeding control method used for recording images by feeding a recording material in a first direction relative to a recording head, said recording head having an array of plural recording elements in said first direction, said image being recorded on said recording material by repeating feeding of said recording head in a second direction perpendicular to said first direction, and said relative feeding each time, said feeding control method comprising the steps of:

determining a correction value C1 in said relative feeding on a random basis within a predetermined range; and feeding said recording material in said first direction relative to said recording head with a corrected feeding amount, which is obtained by adding said correction value to a predetermined basic value.

2. A feeding control method as claimed in claim 1, further comprising the steps of:

determining natural numbers n and m that satisfy $n \geqq m$; and carrying out relative feeding for m times by said corrected feeding amount in every n times of relative feeding.

3. A feeding control method as claimed in claim 1, further comprising the steps of:

determining a natural number R1 on a random basis; and carrying out said relative feeding each time by said corrected feeding amount in every R1 times of relative feeding.

4. A feeding control method as claimed in claim 1, wherein a feeding mechanism carries out said relative feeding by feeding said recording material in said first direction each time, said correction value C1 is determined within the following range;

$$|C1|<(p-k)/2$$

wherein p is an interval between recording dots in said recording material in said first direction, and k is a range of unevenness caused by structural factors of said feeding mechanism.

5. A feeding control method as claimed in claim 1, wherein a feeding mechanism carries out said relative feeding by feeding said recording material in said first direction each time, said correction value C1 is determined within the following range;

$$|C1|<k$$

wherein k is a range of unevenness in feeding amount caused by structural factors of said feeding mechanism.

6. A feeding control method as claimed in claim 1, wherein a feeding mechanism carries out said relative feeding by feeding said recording materials in said first direction each time, and said correction value C1 is determined in the following range;

$$|C1|<15\ \mu m.$$

7. A feeding control method as claimed in claim 1, further comprising the steps of:

storing said correction value C1 in a memory in each relative feeding; and determining said corrected feeding amount for recording next image by using said correction value C1, which is read from said memory.

8. A printer for recording an image on a recording material, said printer comprising:

a recording head having an array of recording elements in a first direction;

a carriage for feeding said recording head in a second direction, which is perpendicular to said first direction;

a feeding mechanism for feeding said recording materials in said first direction relative to said recording head; and a controller for carrying out said relative feeding for a corrected feeding amount obtained by adding a correction value C1, which is determined on a random basis within a predetermined range, to a predetermined basic value.

9. A printer as claimed in claim 8, wherein said controller carries out m times of relative feeding by said corrected feeding amount in every n times of relative feeding.

10. A printer as claimed in claim 8, wherein said controller determines random number R1, and carries out said relative feeding by said corrected feeding amount, once in every R1 times of relative feeding.

11. A printer as claimed in claim 8, further comprising a feeding mechanism for feeding said recording material in said first direction each time, said controller determining said correction value C1 within the following range;

$$|C1|<(p-k)/2$$

wherein p is an interval between recording dots on said recording materials, k is a range of unevenness in feeding amount caused by structural factors in said feeding mechanism.

12. A printer as claimed in claim 8, further comprising a feeding mechanism for feeding said recording material in said first direction each time, said controller determining said correction value C1 within the following range;

$$|C1|<k$$

wherein k is a range of unevenness in feeding amount caused by structural factors of said feeding mechanism.

13. A printer as claimed in claim 8, further comprising a feeding mechanism for feeding said recording material in said first direction each time, said controller determining said correction value C1 within the following range;

$$C1|<15\ \mu m.$$

14. A printer as claimed in claim 8, further comprising a memory for storing said correction value C1 in each relative feeding, said controller determining said corrected feeding amount for recording next image by using said correction value C1, which is read from said memory.

* * * * *